US008413621B2

(12) United States Patent
Rinnert

(10) Patent No.: US 8,413,621 B2
(45) **Date of Patent: *Apr. 9, 2013**

(54) HYDRAULIC ASSEMBLY FOR A CYLINDER HEAD OF AN INTERNAL COMBUSTION ENGINE COMPRISING A HYDRAULICALLY VARIABLE GAS EXCHANGE VALVE TRAIN

(75) Inventor: Andreas Rinnert, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 188 days.

This patent is subject to a terminal disclaimer.

(21) Appl. No.: 13/074,339

(22) Filed: Mar. 29, 2011

(65) Prior Publication Data

US 2011/0259288 A1 Oct. 27, 2011

(30) Foreign Application Priority Data

Apr. 26, 2010 (DE) ..... 10 2010 018 209

(51) Int. Cl.
*F01L 9/02* (2006.01)

(52) U.S. Cl.
USPC ..... 123/90.12; 123/90.13; 92/163; 137/625

(58) Field of Classification Search ..... 123/90.2, 123/90.15, 90.16, 90.52
See application file for complete search history.

(56) References Cited

U.S. PATENT DOCUMENTS 5,263,441 A * 11/1993 Rembold et al. ..... 123/90.12
7,509,933 B2 * 3/2009 Dingle ..... 123/90.52
2007/0105465 A1 * 5/2007 Wolfsgruber et al. ..... 440/88 R

FOREIGN PATENT DOCUMENTS

DE 102007054376 5/2009
DE 102009011983 9/2010

* cited by examiner

*Primary Examiner* — Thomas Denion
*Assistant Examiner* — Deming Wan
(74) *Attorney, Agent, or Firm* — Volpe and Koenig, P.C.

(57) ABSTRACT

A hydraulic assembly (5) for a cylinder head (2) of an internal combustion engine having a hydraulically variable valve train (1) is provided. A high pressure chamber (11), a medium pressure chamber (12) and a low pressure chamber (16), which serves as a hydraulic medium reservoir, are configured in the hydraulic assembly. The low pressure chamber communicates through a throttling point (17) with the medium pressure chamber, which throttling point is formed by a displaceable valve body (19) and, depending on the position of the valve body, provides flow cross-sections of different sizes in order to minimize the leakage out of the hydraulic assembly.

5 Claims, 4 Drawing Sheets

Fig. 1
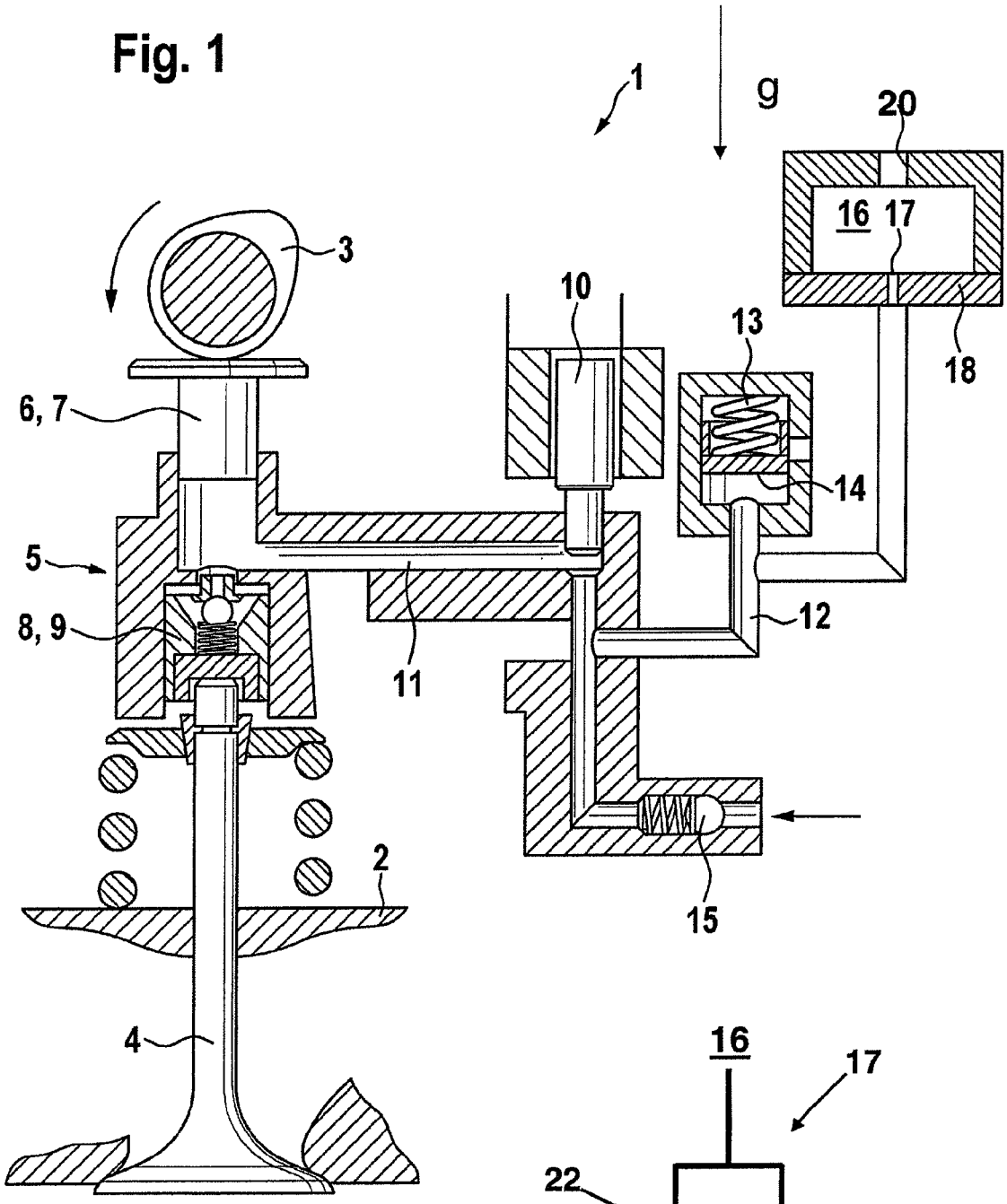
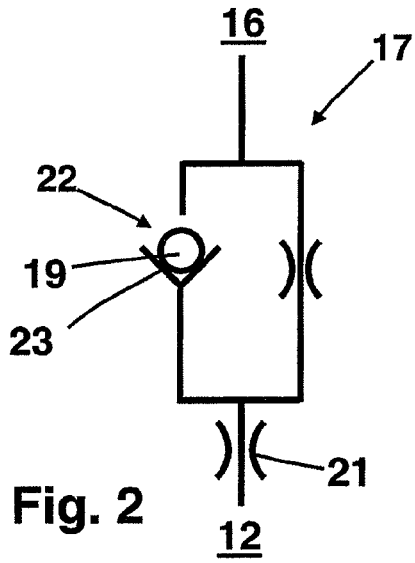
Fig. 2

HYDRAULIC ASSEMBLY FOR A CYLINDER HEAD OF AN INTERNAL COMBUSTION ENGINE COMPRISING A HYDRAULICALLY VARIABLE GAS EXCHANGE VALVE TRAIN

CROSS-REFERENCE TO RELATED APPLICATIONS

This application claims the benefit of German Patent Application No. 102010018209.5, filed Apr. 26, 2010, which is incorporated herein by reference as if fully set forth.

BACKGROUND

The invention concerns a hydraulic assembly for a cylinder head of an internal combustion engine comprising a hydraulically variable gas exchange valve train comprising:

- a hydraulic housing comprising at least one driving side master unit, at least one driven side slave unit and at least one actuable hydraulic valve,
- at least one medium pressure chamber extending in the hydraulic housing,
- at least one high pressure chamber extending in the hydraulic housing and arranged in transmitting direction between the associated master unit and the associated slave unit while being able to be connected through the associated hydraulic valve to the associated medium pressure chamber,
- at least one low pressure chamber extending in the hydraulic housing and serving as a hydraulic medium reservoir while being connected through a throttling point to the associated medium pressure chamber,
- and a valve body which is displacably received in direction of a hydraulic medium flow between the medium pressure chamber and the low pressure chamber in the hydraulic housing and serves to form the throttling point, said throttling point comprising two flow cross-sections of different sizes for the hydraulic medium flow as a function of the position of the valve body.

A hydraulic valve of the pre-cited type is disclosed in the not pre-published document DE 10 2009 011 983 A1. In the hydraulic assembly proposed in this document, all the important components required for the hydraulically variable transmission from cam lobes to the gas exchange valves as well as the pressure chambers are arranged in a common housing. The throttling point which connects the medium pressure chamber to the low pressure chamber which serves as a hydraulic medium reservoir is configured such that the hydraulic medium flowing from the medium pressure chamber into the low pressure chamber must pass through a throttling cross-section, and a low-throttling flow cross-section is provided for the hydraulic medium flow in a reverse direction from the low pressure chamber into the medium pressure chamber. The low throttling in this direction of flow is meant to provide a sufficiently fast availability of a hydraulic medium reservoir for the medium pressure chamber during a cold start of the internal combustion engine.

However, tests carried out by the applicant have shown that a thus configured throttling point promotes the leakage out of the high pressure chamber and the medium pressure chamber and that, already within a few days of standstill of the internal combustion engine, the leakage-compensating low pressure chamber can get emptied. As a consequence, this low pressure chamber is no longer available as a hydraulic medium reservoir during the cold start of the internal combustion engine, and the air volume collected in the meantime in the medium and/or high pressure chamber impedes or prevents, due to its high compressibility, an opening actuation of the gas exchange valves which would be adequate for the starting operation.

These problems are true in a comparable manner for throttling points with constant throttling cross-sections as disclosed in DE 10 2007 054 376 A1.

SUMMARY

The object of the present invention is to improve a hydraulic assembly of the pre-cited type so that the hydraulic medium leakage out of the hydraulic assembly is minimized with the result that, even after a longer standstill time of the internal combustion engine, the opening actuation of the gas exchange valves required for a successful starting operation of the engine is adequately guaranteed.

The manner in which this object is achieved results from the features of the invention, whereas advantageous developments and embodiments are to be seen in the description and claims. According to the invention, the first flow cross-section available for the hydraulic medium flow out of the medium pressure chamber into the low pressure chamber is larger than the second flow cross-section available for the hydraulic medium flow out of the low pressure chamber into the medium pressure chamber.

In contrast to the initially cited prior art, the throttling point is to be configured such that it offers a lower resistance to the hydraulic medium flow out of the medium pressure chamber into the low pressure chamber than to a reverse hydraulic medium flow out of the low pressure chamber into the medium pressure chamber. Consequently, it is not a primary object of the invention to provide, in the form of the low pressure chamber, a sufficiently fast availability of a hydraulic medium reservoir for the medium pressure chamber and the high pressure chamber during the start of the internal combustion engine but rather to minimize to the largest possible extent, the hydraulic medium leakage out of the hydraulic assembly during the standstill time prior to engine starting. This is achieved according to the invention by the fact that compared to known systems, the second flow cross-section permits a comparatively small volume flow out of the low pressure chamber into the medium pressure chamber, which volume flow is defined within pre-determined limits and inhibits leakage.

This small volume flow effects a constant pressure equalization between the pressure chambers which, with a view to cyclic changes in the ambient temperature, such as day-night changes or varying solar radiation during the standstill time of the internal combustion engine, can have a considerable influence on the leakage behavior of the hydraulic assembly. It is clear that in the absence of pressure equalization, the pressure chambers would be successively pumped empty due to temperature-related pressure differences and, consequently, a corresponding quantity of surrounding air would be sucked in within a few days of engine standstill.

Besides this, there is a temperature-dependent leakage due to the viscosity curve of the hydraulic medium. After the hot internal combustion engine has been shut off, the leakage of the then low-viscosity hydraulic medium is greater but this can be compensated at the same time through the then comparatively low flow resistance of the throttling point. As already discussed above, even a reduction of the volume of the cooling hydraulic medium in the medium pressure chamber and the high pressure chamber does not lead to a resuction of surrounding air into these pressure chambers because the throttling point between the medium pressure chamber and the high pressure chamber effects the required pressure equalization. After the internal combustion engine has cooled down to the ambient temperature, the viscosity of the hydraulic medium is correspondingly high so that leakage out of the pressure chambers is clearly reduced, in the ideal case to zero.

In a further development of the invention, the valve body is a ball which lifts off the valve seat of a ball valve in direction of the low pressure chamber. The second flow cross-section, when the ball is in bearing relationship with the valve seat, is defined by a non-circular cross-section of the valve seat. The cross-section of the valve seat can have the shape of a regular polygon comprising, for instance, three or five rounded corners. Seen three-dimensionally, the valve seat is advantageously configured with a shape similar to a frustum of a cone and the contact surface with the ball—viewed in a longitudinal section through the ball valve—can be convex, concave or straight.

The first cross-section can be defined by a throttling bore which is arranged hydraulically in series with the ball valve. In a preferred structural embodiment, the valve seat of the ball valve is formed integrally (preferably by a cold shaping method like stamping), on a cylindrical valve carrier which is pressed from the side of the low pressure chamber into a stepped bore of the hydraulic housing and presses a throttling disk, through which the throttling bore extends, against a bore step of the stepped bore.

It is also possible to provide, in addition to the inventive throttling point, a non-return valve arranged between the low pressure chamber and the medium pressure chamber and opening in direction of the medium pressure chamber. This non-return valve is closed during the standstill time of the internal combustion engine and permits, during the following start of the engine, a low-resistance flow of hydraulic medium out of the low pressure chamber into the medium pressure chamber due to the partial vacuum being formed at this time in the medium pressure chamber.

BRIEF DESCRIPTION OF THE DRAWINGS

Further features of the invention result from the following description and the appended drawings in which examples of embodiment of the invention are illustrated. If not otherwise stated, similar or functionally similar features or components are given the same reference numerals. The figures show:

FIG. 1 is a schematic representation of a hydraulically variable gas exchange valve train;

FIG. 2 is a throttling point according to the invention;

DETAILED DESCRIPTION OF THE PREFERRED EMBODIMENTS

Figure 3:
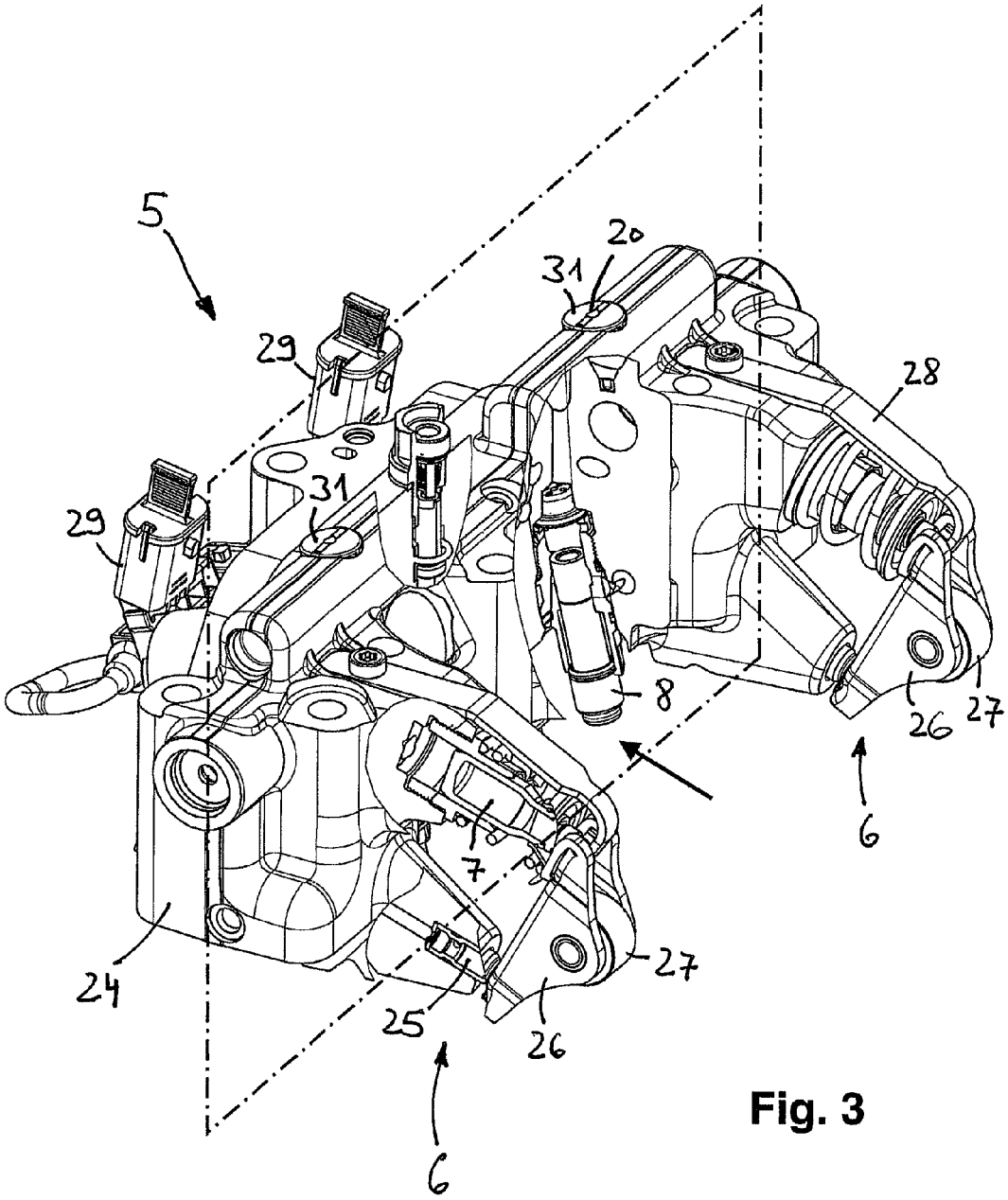
FIG. 3 is a hydraulic assembly according to the invention, in a general perspective illustration.

FIG. 1 discloses the basic structure of a hydraulically variable gas exchange valve train 1 in a schematic representation. The figure shows a section of a cylinder head 2 of an internal combustion engine comprising a cam 3 of a camshaft and a gas exchange valve 4 which is loaded by spring force in closing direction. This illustration is relevant for obtaining an understanding of the invention. The variability of the gas exchange valve train 1 is effected with the help of a hydraulic assembly 5 arranged between the cam 3 and the gas exchange valve 4. This hydraulic assembly 5 comprises the following components:

- a driving side master unit 6, in the present case in form of a pump tappet 7 driven by the cam 3,
- a driven side slave unit 8, in the present case in form of a slave piston 9 which actuates the gas exchange valve 4 directly,
- an actuable hydraulic valve 10, in the present case in form of an electromagnetic 2-2-way switching valve which is open in a currentless state,
- a high pressure chamber 11 extending in direction of transmission of the cam lift 3 to the gas exchange valve 4 between the master unit band the slave unit 8, out of which high pressure chamber 11 hydraulic medium can flow into a medium pressure chamber 12 in an opened state of the hydraulic valve 10,
- a pressure reservoir 13 connected to the medium pressure chamber 12 comprising a compensation piston 14 loaded by spring force,
- a non-return valve 15 opening in direction of the medium pressure chamber 12, through which non-return valve 15 the hydraulic assembly 5 is connected to the hydraulic medium circulation of the internal combustion engine,
- and a low pressure chamber 16 serving as a hydraulic medium reservoir which is situated geodetically above (according to arrow direction of acceleration due to gravity g) the medium pressure chamber 12 and the high pressure chamber 11 while being connected to the medium pressure chamber 12 through a throttling point 17 situated in a separating wall 18 which separates the low pressure chamber 16 from the medium pressure chamber 12.

The low pressure chamber 16 comprises an overflow 20 which opens into the cylinder head 2. This overflow 20 serves not only for venting the low pressure chamber 16 but also for cooling the hydraulic assembly 5 by the fact that heated hydraulic medium can escape via the low pressure chamber 16 into the cylinder head 2 and can thus be returned into the cooled hydraulic medium circulation of the internal combustion engine.

The mode of functioning of the hydraulic gas exchange valve train 1, known per se, can be summarized as follows: the high pressure chamber 11 acts as a hydraulic linkage between the master unit band the slave unit 8, whereby the hydraulic volume—neglecting leakages—which is displaced by the pump tappet 7 proportionately to the lift of the cam 3 as a function of the point of time of opening and the duration of opening of the hydraulic valve 10 is divided into a first partial volume loading the slave piston 9 and a second partial volume flowing into the medium pressure chamber 12 including the pressure reservoir 13. This enables the transmission of the lift of the pump tappet 7 to the slave piston 9 and thus also a fully variable adjustment not only of the timing but also of the lift height of the gas exchange valve 4.

FIG. 2 shows the throttling point 17 in form of a hydraulic symbol. What is important for the invention is the existence of a valve body 19 which is displaceable in direction of the hydraulic medium flow between the medium pressure chamber 12 and the low pressure chamber 16 for forming the throttling point 17, such that the throttling point 17 possesses two flow cross-sections of different sizes for the hydraulic medium flow depending on the position of the valve body 19.

For this purpose, the throttling point 17 is configured as a series connection between a bottleneck 21 on one side, and a ball valve 22 including ball 19 and valve seat 23 on the other side. Starting from its support on the valve seat 23, the ball lifts off in direction of the low pressure chamber 16 and enables a low-throttling flow through the ball valve 22. Consequently, the first flow cross-section which is determinative for hydraulic medium flow from the medium pressure chamber 12 into the low pressure chamber 16 is defined by the dimension of the bottleneck 21. The valve seat 23 has such a geometric shape that it does not seal completely with the ball 19 supported thereon. Rather, when the ball 19 is in bearing relationship with the valve seat 23, a pre-determined leakage of the ball valve 22 is created, as symbolized without a reference numeral, through the bottleneck extending parallel to the ball valve 22. Because the first flow cross-section—determined by the bottleneck 21—is clearly larger than the second flow cross-section—determined by the closed ball valve 22, the hydraulic medium flow from the low pressure chamber 16 into the medium pressure chamber 12 is throttled clearly more strongly than the flow in the opposite direction. As initially mentioned, the clearly smaller second flow cross-section prevents a leakage-related fast emptying of the pressure chambers 11, 12 and 16 and enables, at the same time, a pressure equalization between the pressure chambers which counteracts a successive pumping-empty of the pressure chambers and the simultaneous suction of air.

FIG. 3 shows an assembled hydraulic assembly 5 in which all the initially listed components are lodged in a one-piece hydraulic housing 24. The hydraulic assembly 5 is mounted into the cylinder head of a 2-cylinder series engine as a pre-assembled structural unit filled with hydraulic medium. Each of the two master units 6 comprises a support element 25, a finger lever 26 pivotally mounted therein and comprising a roller 27 mounted in the finger lever 26 for a low-friction cam contact and a pump tappet 7, actuated in the present case by the finger lever 26 and loaded by spring force in reverse lift direction. Clips 28 serve as an anti-loss device for the finger levers 26 in the case of a hydraulic assembly 5 not installed in the cylinder head. The hydraulic assembly 5 is further configured such that each of the master units 6 cooperates with two slave units 8. In other words, only one cam and only one master unit 6 is required for each pair of identically operating gas exchange valves, in the present case the inlet valves of a cylinder of the internal combustion engine, the hydraulic volume displaced by the pump tappet 7 simultaneously loading both the slave units 8. The electric connection plugs 29 for the hydraulic valves, associated in each case to one master unit 6 and two slave units 8, are to be seen on the side of the hydraulic assembly 5 situated opposite the master units 6. The hydraulic valves 10 which are open in the currentless state, are fixed in valve receptions, known per se and not specifically shown, in the hydraulic housing 24.

Figure 4:
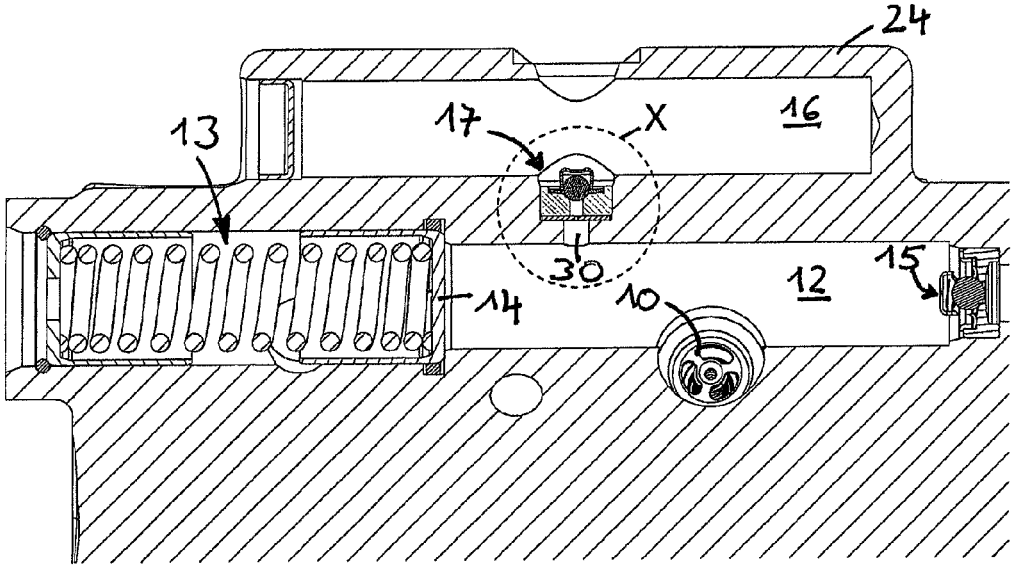
FIG. 4 is a longitudinal section view through the hydraulic assembly according to FIG. 3 showing the throttling point.

FIG. 4 shows a sectional view through the hydraulic assembly 5 corresponding to the sectional plane indicated by chain-dotted lines in FIG. 3. The medium pressure chamber 12 is connected on one side through the non-return valve 15 to the hydraulic medium supply of the internal combustion engine and on the other side to the spring-force loaded compensation piston 14 of the pressure reservoir 13. Also to be seen is the inner end of the hydraulic valve 10 opening into the medium pressure chamber 12. The connection between the low pressure chamber 16 serving as a hydraulic medium reservoir and the medium pressure chamber 12 is established through a stepped bore 30 whose inlet into the hydraulic housing 24 is closed by a stopper 31 through which the overflow 20 extends (see FIG. 3). Both, air bubbles which penetrate during the operation of the internal combustion engine via the throttling point 17 out of the medium pressure chamber 12 into the low pressure chamber 16, as also superfluous hydraulic medium can be discharged via the overflow 20 into the interior of the cylinder head.

Figure 5:
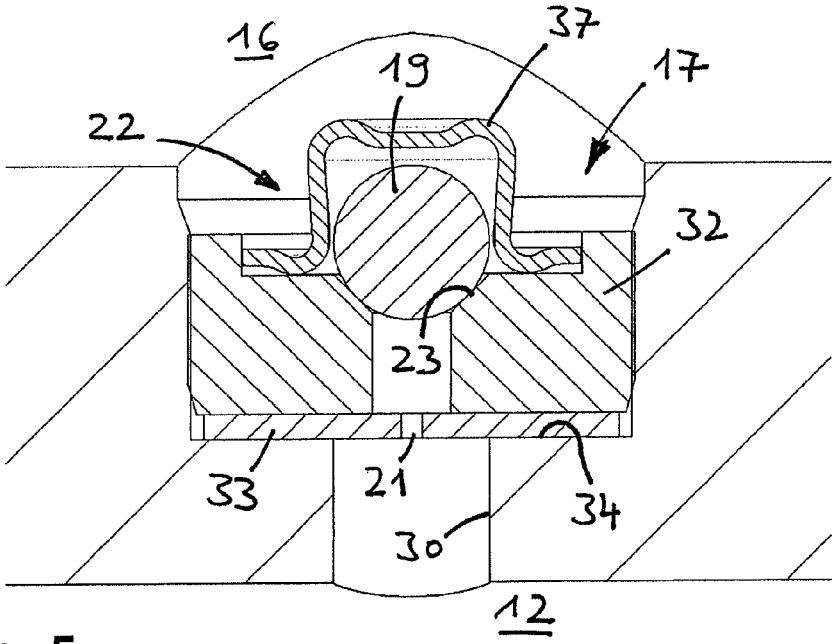
FIG. 5 is the detail X of FIG. 4 in an enlarged representation.
Figure 6:
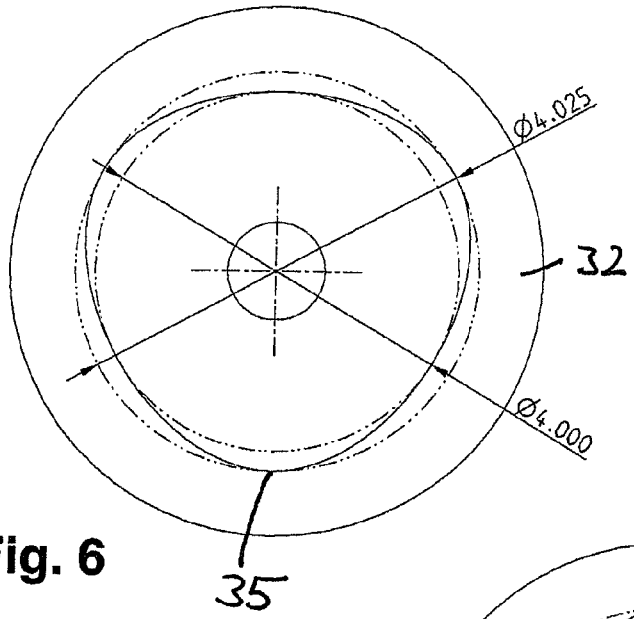
FIG. 6 shows the geometry of a first valve seat according to the invention, in a top view.
Figure 7:
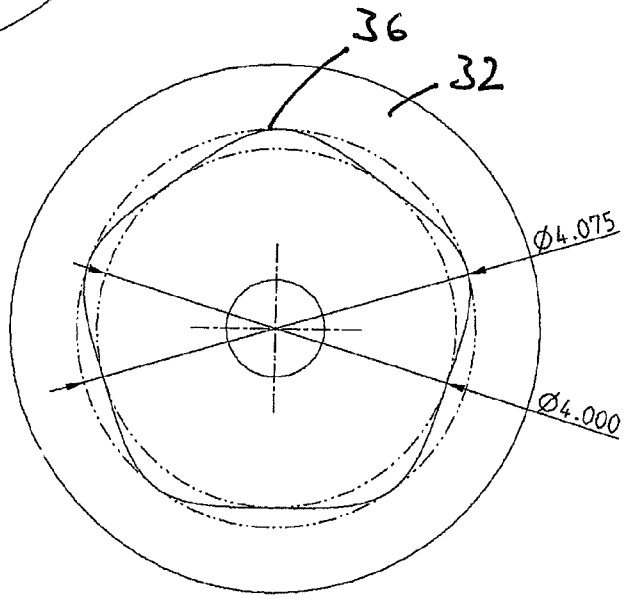
FIG. 7 shows the geometry of a second valve seat according to the invention, in a top view.

FIG. 5 shows an enlarged illustration of the throttling point 17 fixed in the stepped bore 30. The valve seat 23 of the ball valve 22 is formed on a cylindrical valve carrier 32 that is pressed into the stepped bore 30 from the side of the low pressure chamber 16 and presses a throttling disk 33 against a bore step 34. The first flow cross-section that is determinative for the hydraulic medium flow from the medium pressure chamber 12 into the low pressure chamber 16 is defined by the bottleneck 21 in the form of a throttling bore extending through the throttling disk 33. The throttling bore is arranged hydraulically in series with the ball valve 22 and has, in the present case, a diameter of 0.4 mm. The second flow cross-section that is determinative for the reverse hydraulic medium flow from the low pressure chamber 16 into the medium pressure chamber 12 is defined by the shape of the valve seat 23 when the ball 19 is in bearing relationship therewith. In the bearing region of the ball 19, the valve seat 23 has a non-circular cross-section as illustrated in FIGS. 6 and 7 showing two embodiments in not-to-scale, strongly enlarged top views of the valve carrier 32. In both cases, the cross-sections have a shape of a regular polygon, 35 or 36, with three or five rounded corners. The actual dimensional deviations of the polygon 35, 36 from the circular shape can be seen in each case from size measures indicated in said figures.

Figure 8:
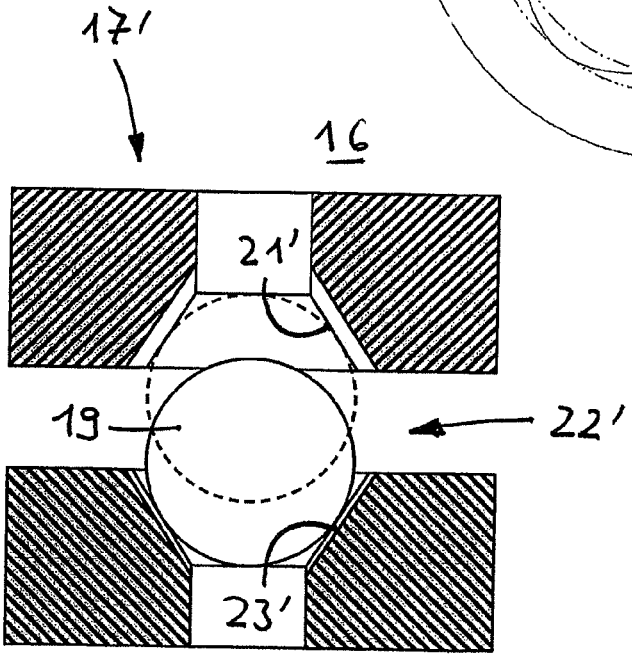
FIG. 8 shows an alternatively configured throttling point in a schematic sectional representation.

An alternative embodiment of a throttling point 17' is disclosed in FIG. 8 in a schematic illustration. In this case, a ball valve 22' likewise comprises a ball 19 which is displaceable between two valve seats 21' and 23'. As elucidated in the preceding example of embodiment, the lower valve seat 23' extending on the side of the medium pressure chamber 12 determines the second flow cross-section when the ball 19 is in bearing relationship therewith, and corresponds geometrically to the valve seat 23 shown in FIG. 6 or 7. In contrast, the upper valve seat 21' extending on the side of the low pressure chamber 16 replaces the throttling disk 33 and the valve cap 37 of FIG. 5. The larger, first flow cross-section in this case is likewise determined by a pre-defined leakage between the upper valve seat 21' and the ball 19 bearing against this valve seat (indicated by a broken line). This leakage is likewise produced by a cross-section of the upper valve seat 21' deviating from the circular shape, the deviations, however, have clearly larger dimensions than illustrated in FIGS. 6 and 7.

LIST OF REFERENCE NUMERALS

1 Gas exchange valve train
2 Cylinder head
3 Cam
4 Gas exchange valve
5 Hydraulic assembly
6 Master unit
7 Pump tappet
8 Slave unit
9 Slave piston
10 Hydraulic valve
11 High pressure chamber
12 Medium pressure chamber
13 Pressure reservoir
14 Compensation piston
15 Non-return valve
16 Low pressure chamber
17 Throttling point

18 Separating wall
19 Valve body/ball
20 Overflow
21 Bottleneck/throttling bore/upper valve seat
22 Ball valve
23 Valve seat
24 Hydraulic housing
25 Support element
26 Finger lever
27 Roller
28 Clip
29 Connection plug of the hydraulic valve
30 Stepped bore
31 Stopper
32 Valve carrier
33 Throttling disk
34 Bore step
35 Polygon
36 Polygon
37 Valve cap

The invention claimed is:

1. A hydraulic assembly for a cylinder head of an internal combustion engine having a hydraulically variable gas exchange valve train, comprising:

a hydraulic housing comprising at least one driving side master unit, at least one driven side slave unit and at least one actuable hydraulic valve, at least one medium pressure chamber extending in the hydraulic housing, at least one high pressure chamber extending in the hydraulic housing and arranged in a transmitting direction between the associated master unit and the associated slave unit while being able to be connected through the associated hydraulic valve to the associated medium pressure chamber, at least one low pressure chamber extending in the hydraulic housing and serving as a hydraulic medium reservoir while being connected through a throttling point to the associated medium pressure chamber, a valve body which is displacably received in a direction of a hydraulic medium flow between the medium pressure chamber and the low pressure chamber in the hydraulic housing and serves to form the throttling point, the throttling point comprises first and second flow cross-sections of different sizes for the hydraulic medium flow as a function of the position of the valve body, and the first flow cross-section available for the hydraulic medium flow out of the medium pressure chamber into the low pressure chamber is larger than the second flow cross-section available for the hydraulic medium flow out of the low pressure chamber into the medium pressure chamber.

2. A hydraulic assembly according to claim 1, wherein the valve body is a ball which lifts off a valve seat of a ball valve in a direction of the low pressure chamber, the second flow cross-section, formed when the ball is in a bearing relationship with the valve seat, being defined by a non-circular cross-section of the valve seat.

3. A hydraulic assembly according to claim 2, wherein the non-circular cross-section of the valve seat is shaped as a regular polygon with rounded corners.

4. A hydraulic assembly according to claim 2, wherein the first cross-section is defined by a throttling bore which is arranged hydraulically in series with the ball valve.

5. A hydraulic assembly according to claim 4, wherein the valve seat of the ball valve is formed integrally on a cylindrical valve carrier which is pressed from a side of the low pressure chamber into a stepped bore of the hydraulic housing and presses a throttling disk, through which the throttling bore extends, against a bore step of the stepped bore.

* * * * *